United States Patent [19]

Boyle

[11] 4,368,665

[45] Jan. 18, 1983

[54] METHOD FOR IMPRINTING MULTIPLE PERMUTATIONS AND COMBINATIONS OF CARDS AND THE LIKE ON DRINKING CUPS AND PRODUCTS MANUFACTURED THEREBY

[75] Inventor: Patrick T. Boyle, Baltimore, Md.

[73] Assignee: Maryland Cup Corporation, Owings Mill, Md.

[21] Appl. No.: 220,916

[22] Filed: Dec. 29, 1980

Related U.S. Application Data

[62] Division of Ser. No. 29,073, Apr. 11, 1979, Pat. No. 4,287,824.

[51] Int. Cl.[3] ..... B41F 17/28

[52] U.S. Cl. ..... 101/93.01; 101/76; 101/426; 270/1.1

[58] Field of Search ..... 101/66–69, 101/426, 93.01, 38 A, 38 R, 39, 40, 76, 91–92, 172, 212, 45; 270/1.1

[56] References Cited

U.S. PATENT DOCUMENTS

| | | | |
|---|---|---|---|
| 1,586,915 | 6/1926 | Pendernast | 270/1.1 |
| 3,083,640 | 4/1963 | Milner | 101/172 |
| 3,289,552 | 12/1966 | Corazzo | 101/38 R |
| 3,421,752 | 1/1969 | Felino | 270/1.1 |
| 3,621,780 | 11/1971 | Tillotson | 101/172 |
| 3,822,876 | 7/1974 | Frein | 270/1.1 |
| 3,915,085 | 10/1975 | Lehmann | 101/38 A |
| 3,988,015 | 10/1976 | Scontlin | 270/1.1 |
| 3,998,446 | 12/1976 | Dent | 270/18 |
| 4,287,824 | 9/1981 | Boyle | 107/76 X |

*Primary Examiner*—Edward M. Coven

*Attorney, Agent, or Firm*—Birch, Stewart, Kolasch & Birch

[57] ABSTRACT

A method is provided for printing games such as poker hands on two-piece frustoconical containers with four cards up and one down on the container sidewall and a hole card or draw card on the bottom of the container. The sidewalls are formed from blanks printed in a sequence by four, five, six and seven-around printing cylinders, all of which impress one card identity indicia on each printed cup blank on a strip of stock passed through the array of cylinders. A strip of bottom blanks each bearing a single card identity are printed in sequence by an eleven-around printing cylinder and the sidewall blanks and bottom blanks are assembled in the printed sequence to provide at least 4,620 cups all bearing poker hands with no two cups bearing identical hands. None of the card identity indicia on the several rolls is repeated. A total of thrity-three different indicia is used in the present method.

4 Claims, 12 Drawing Figures

METHOD FOR IMPRINTING MULTIPLE PERMUTATIONS AND COMBINATIONS OF CARDS AND THE LIKE ON DRINKING CUPS AND PRODUCTS MANUFACTURED THEREBY

This application is a divisional, of copending application Ser. No. 29,073, filed on Apr. 11, 1979, now U.S. Pat. No. 4,287,824.

FIELD OF THE INVENTION

This invention relates to amusement devices and more particularly, to a drinking cup having a plurality of playing cards printed on the sidewalls and bottom thereof, depicting a hand, and wherein the ultimate strength of the hand is finally determined by the hidden card printed on the bottom of the cup, and to a method and apparatus for producing such cups with a multiplicity of permutations and combinations of cards to enhance the number of hands that can be printed on a given plurality of cups in a single printing run.

BACKGROUND OF THE INVENTION

In the merchandising of soft drinks and other beverages, it is often quite desirable to provide promotional programs such as riddles, humorous cartoons, and games for a purchaser's amusement subject to the purchase of a beverage or the like in a disposable cup or container.

One particularly interesting and popular form of amusement is the participation of the customer in a card game or the like wherein a hand of a particularly well known card game, such as poker, is printed in various permutations and combinations on a run of cups so that some competitive amusement between purchasers or perhaps some premium arrangement with the establishment can be achieved by comparison of the strength of the hand on a given cup with those of other purchasers or a standard of the establishment.

The present invention relates to the printing of poker hands on two-piece frustoconical drinking cups and the like which include a sidewall adapted to be printed in sequence on a strip of stock and a bottom portion which is printed on a separate strip of stock but which may be indexed with and applied to respective sidewalls in a conventional cup-making machine of any desirable type.

The sidewalls of conventional paper cups are printed on paper strip stock or paperboard in a basically arcuate configuration in which the outboard edges are ultimately overlapped when the sidewall is blanked from the stock to form a side seam and a bottom curl is utilized to retain a bottom disc within the lowermost portion of the sidewall.

Assuming that a five card poker hand is the desired end result of the imprint to be made on a given cup, four of the cards should be determinable from looking at the sidewall and a draw card or hole card, being a term of art in the game of poker, is visible from observing the exterior of the bottom disc placed in the cup.

It is, therefore, an object of the present invention to provide a new and novel method and apparatus and resulting drinking cup or the like having a maximized number of permutations and combinations of poker hands formed thereon for a given printing run of sidewall and bottom stock.

Other objects of the present invention will become more fully apparent with respect to the following specification and drawings which relate to a preferred embodiment of the present invention.

SUMMARY OF THE INVENTION

Cup sidewall stock initially consisting of a paper roll of sufficient width to print four sidewall blanks across and in series along the roll such that once an entire roll of blanks has been preprinted, it can be slit during this time to form four individual stock rolls of sequentially printed cup blanks.

A similar condition is preferred for printing bottom stock where a single card or representation of a card such as a rectangle with a number and a suit symbol are included within the rectangle in a series along a strip of stock which may be printed as twelve strips across and slit while being printed to form twelve tandem stock rolls of bottom blanks. Suitable indexing marks can also be printed on this stock so that it can be suitably indexed with the sidewall blanks in conventional cup-making equipment.

In printing a given sequence of sidewall blanks on each stock roll thereof, printing rolls in two colors are utilized with four rolls in tandem. The first print roll in the tandem set includes four card identifications or "four-around" impressions on the roll for each of the stock rolls to be printed in the four across configuration.

The second roll includes one additional card identification symbol, namely, five card identifications in a "five-around" printing configuration. Also, certain card shapes or outlines and copy to be placed on the sidewall of a different color than the card identifications of the first roll are provided on the second roll. Furthermore, the first roll is provided with any copy of an alternate color to that copy provided by the second roll.

Therefore, by the time the cup blanks reach the third printing roll they contain two card impressions each together with all copy, logos and designs that will be borne by the final sidewall blanks.

Proceeding then to roll three, one further additional card identifying symbol is provided on roll No. 3 from roll No. 2, namely, six distinct card identification symbols in a "six-around" printing configuration.

A similar progression is provided for printing roll No. 4 which is provided with one additional card identification compared to roll No. 3, namely, seven cards in a "seven-around" printing configuration.

These rolls are in alignment and the additional card configurations are in side-by-side rows such that an open poker hand configuration including one downturned hole card or draw card may be printed, cardback only, on the sidewall blank.

The printing configuration for the draw card or hole card on the bottom stock is in a twelve across printing format with eleven sequential card identifying symbols and/or outlines in an eleven-around printing configuration.

Therefore, when the 4, 5, 6 and 7-around permutation and combination printing is combined with the 11-around combination printing of the bottom stock, a total of 4,620 poker hands will result from each individual run of sidewall and cup bottom blanks. This is assuming, of course, that a total of 4,620 continuous sequential bottom blanks and sidewall blanks are matched in the same sequence as they are printed.

Thus, all of the material feeding a high-speed cup-making machine can be contained in continuous material strips rather than precut and placed in magazines or if magazines are used, no shuffling or intermingling of blank sidewalls and bottom plates is required to achieve a relatively maximized number of poker hands.

DETAILED DESCRIPTION OF THE DRAWINGS

Figure 1A:
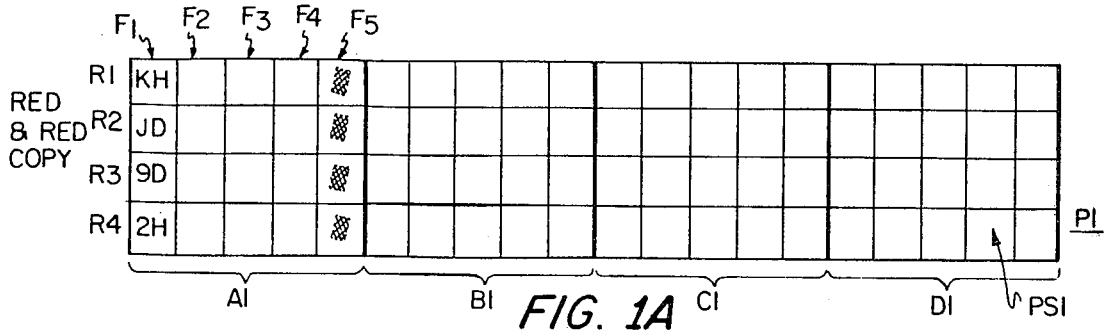
FIG. 1A is a schematic of a first print roll illustrating a four-around printing configuration.
Figure 1B:
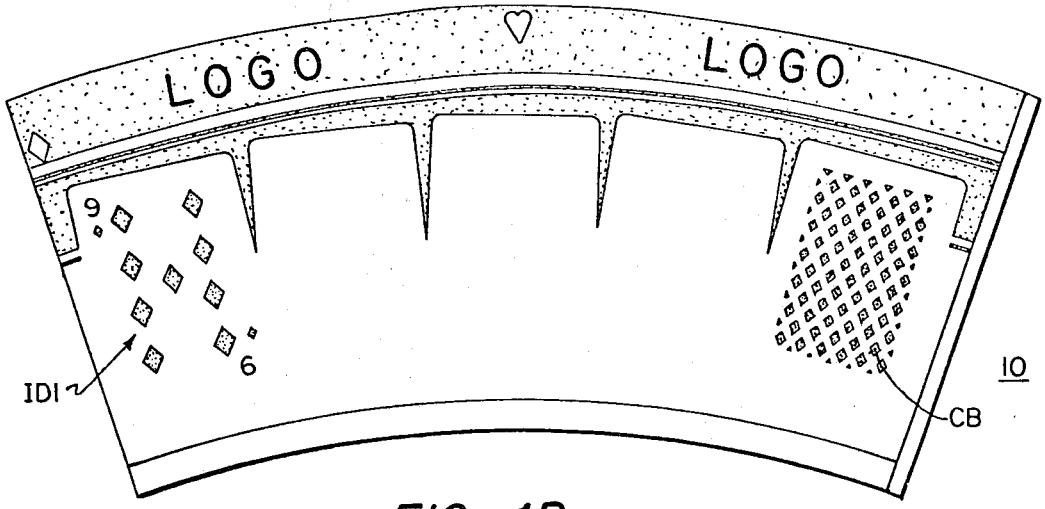
FIG. 1B is a cup blank printed by the print roll of FIG. 1A.

Referring first to FIGS. 1A and 1B, FIG. 1A represents a schematic diagram of the peripheral printing surface PS1 of a first print roll P1 having longitudinally disposed thereon a total of four printing zones A1, B1, C1 and D1, each of which subtend five longitudinally disposed font locations F1 through F5 as illustrated for the print zone A1. Each printing zone A1 . . . D1 includes identical font locations F1 . . . F5 which bear the same identical formats in corresponding font rows R1, R2, R3 and R4 illustrated adjacent the zone A1.

Thus, the print roll P1 of FIG. 1A is a five-across, four-around print roll in which four printing plates corresponding to the rows R1 . . . R4 and the respective five font positions F1 . . . F5 in each row are positioned around the periphery PS1 of the print roll P1.

Schematically illustrated in FIG. 1A are four distinct initial printing formats for a sidewall blank to be printed on a strip of stock, as follows:

Row R1: King of Hearts and a cardback design in the fonts F1 and F5, respectively, together with all indicia and copy of a first color such as red.

Row R2: Jack of Diamonds in font position F1 together with the cardback design in font F5 and other indicia as indicated;

Row R3: Nine of Diamonds and the cardback and general indicia as above; and

Row R4: Two of Hearts and a cardback design and other indicia as indicated.

As shown in FIG. 1B, which is lined for the color red by way of example, and which illustrates the printing plate corresponding to the row R3 on the first printing plate P1, the first card identification format consisting of the nine of Diamonds and a cardback design CB together with a red outline forming the descriptive material, trademark or logo desired to be placed on the cup blank such as the words "Name of the Game" and logo as illustrated in the red field in FIG. 1B on the outlined cup blank 10 illustrated therein.

Therefore, for each revolution of the print roll P1 of FIG. 1A, four first card identifications ID1 together with a cardback CB upon which to build other card identifications to provide a plurality of poker hands together with basic indicia of a two-color set of composite indicia are formed in sequence on adjacent sidewall blanks 10 along a strip of stock similar to the strip of stock illustrated in FIG. 5B containing the bottom blanks to be hereinafter more fully described. The only difference between the bottom blank stock and the sidewall stock is one of dimension and not kind.

For succeeding print rolls in the composite printing process which produces the cup blanks 10 with a plurality of permutations and combinations of card identities 1D thereon, the font position formats F1 . . . F5 and the row designations corresponding to individual printing plates R1 . . . R4 will be followed with the extent of the R designations increased as the number of plates around each succeeding printing roll is increased.

Figure 2A:
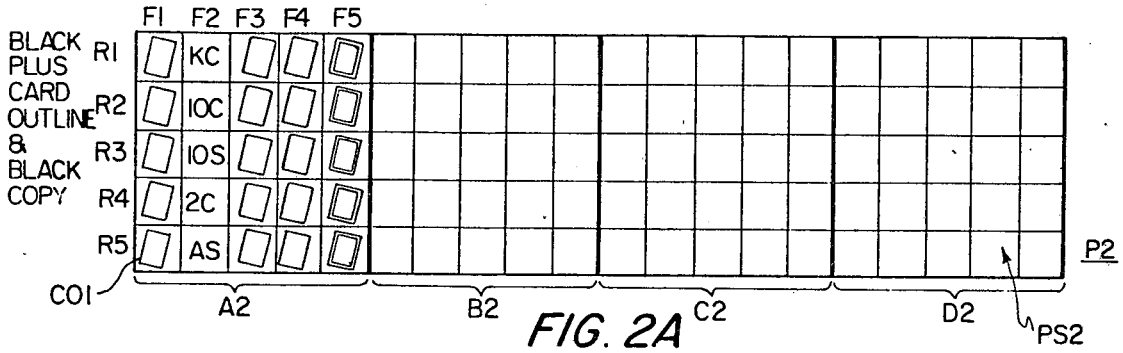
FIG. 2A is a schematic of a five-around print roll.
Figure 2B:
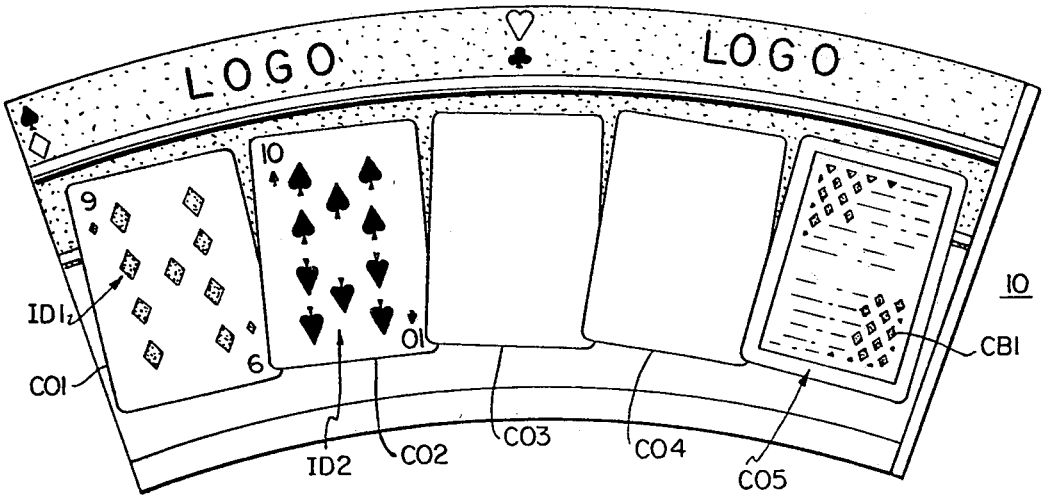
FIG. 2B is a cup blank which has been printed by the third print font or position of each of the first and second print rolls.

By way of example, reference is now made to FIG. 2A in which a second print roll P2 in tandem immediately downstream from the first print roll P1 and being inked with a second distinct color such as the color black for which the drawing in FIG. 2B is lined in addition to the color red already placed upon the print blank 10 by the preceding printing roll P1, it can be seen that the same number of font positions F1 . . . F5 are provided in four zones to achieve four-across printing in the print roll P2 but that the roll P2 is set up for five-around printing requiring one additional row R5 corresponding to a fifth printing plate around the periphery PS2 of the print roll P2. All of the font positions F1 in each of the rows R1 through R5 include a card outline CO1 corresponding to the first card identity ID1 previously printed on the blank 10; the second font positions F2 include second card identities ID2 which reading from rows R1 . . . R5, are, respectively, King of Clubs, Ten of Clubs, Ten of Spades, Two of Clubs, and Ace of Spades, as schematically illustrated in FIG. 2A. The third font position F3 includes a card outline CO3 to receive a third card identity ID3 (FIG. 3A); the fourth font position F4 includes a fourth card outline CO4 to receive a fourth card identity ID4 (FIG. 4A); and the fifth font position F5 includes the double border CO5 illustrated in FIG. 2B around the cardback design CB1 already printed on the blanks exposed to the print roll P2 by the first print roll P1. Also, as clearly seen by the resulting print-out from row R3 on each of the first and second print rolls P1 and P2, all of the card outlines and copy together with the identifications ID1 and ID2 for the first and second cards in a desired ultimate poker hand are now present on the cup blank 10 in its illustrated flow beneath each succeeding print roll in a series of four print rolls P1, P2, P3 and P4, the print rolls P3 and P4 being illustrated in FIGS. 3A and 4A and the resulting blanks therefrom being illustrated in FIGS. 3B and 4B, respectively.

Figure 3A:
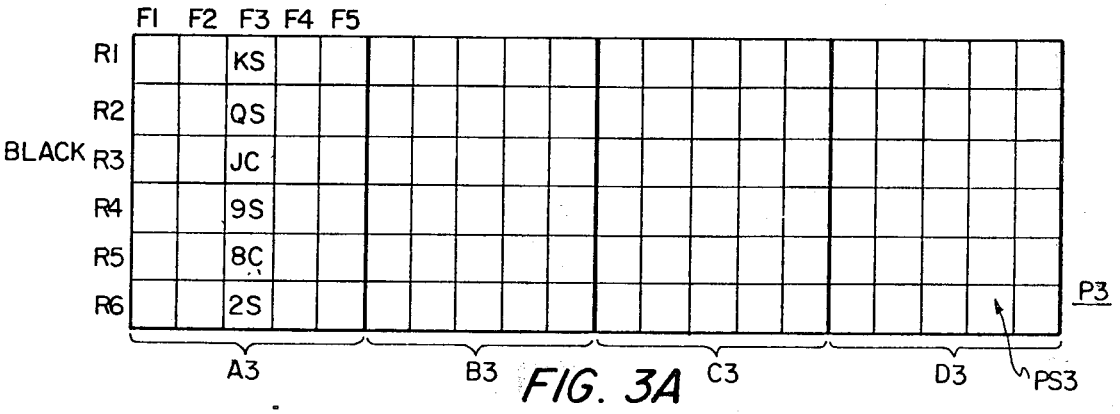
FIG. 3A is a schematic of a third six-around print roll of the present invention.
Figure 3B:
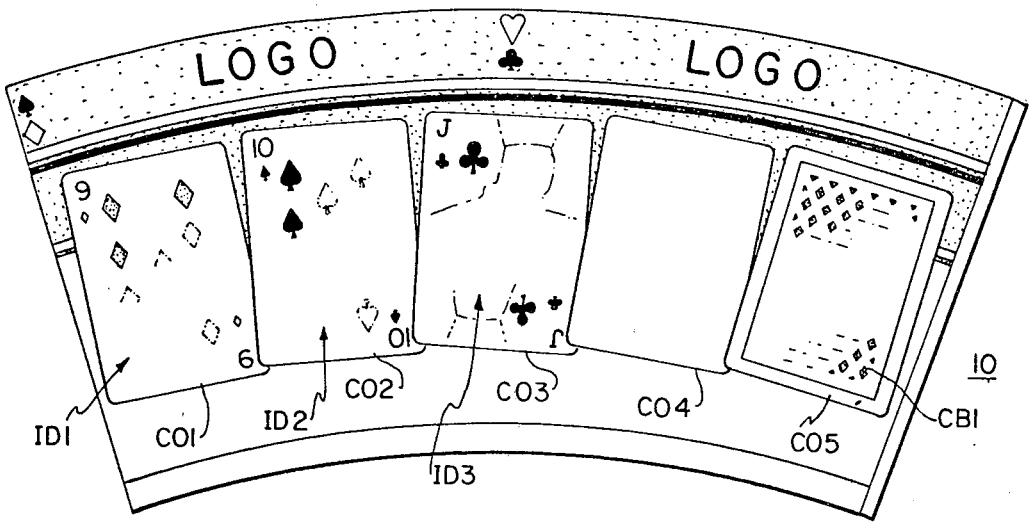
FIG. 3B is a cup blank printed by the combined third font positions of the first, second and third print rolls.

Referring next to FIGS. 3A and 3B, the third print roll P3 is shown as including four-across printing zones A3 through D3 in which the five font positions F1 through F5 are present as illustrated in connection with the first printing zone A3 but in which one additional printing plate is provided at an additional row position R6 for six-around printing on the roll P3. Thus, for each revolution of the print roll P3 there are six additional third card identifications ID3 placed on successive blanks 10 and the third row identification ID3 is illustrated in FIG. 3B as the Jack of Clubs.

The first, second, fourth and fifth font positions are vacant on the third print roll P3 in each of the zones A3 through D3 and the third font position in each zone from row R1 through R6 bears the third card identification ID3 in the following sequence:

King of Spades, Queen of Spades, Jack of Clubs, Nine of Spades, Eight of Clubs, and Two of Spades.

In keeping with the third row combination in the multiplicity of permutations and combinations of ultimate poker hands to be imprinted upon the sidewall blank 10 at the point of exit from the printing position of the third print roll P3, the cup blank 10 bears first, second and third indicia ID1 . . . ID3 comprising the Nine of Diamonds, Ten of Spades, and Jack of Clubs, respectively, as illustrated in FIG. 3B, together with the outline CO4 of the fourth card and the cardback design CB1 and all other outlines and indicia as illustrated.

Figure 4A:
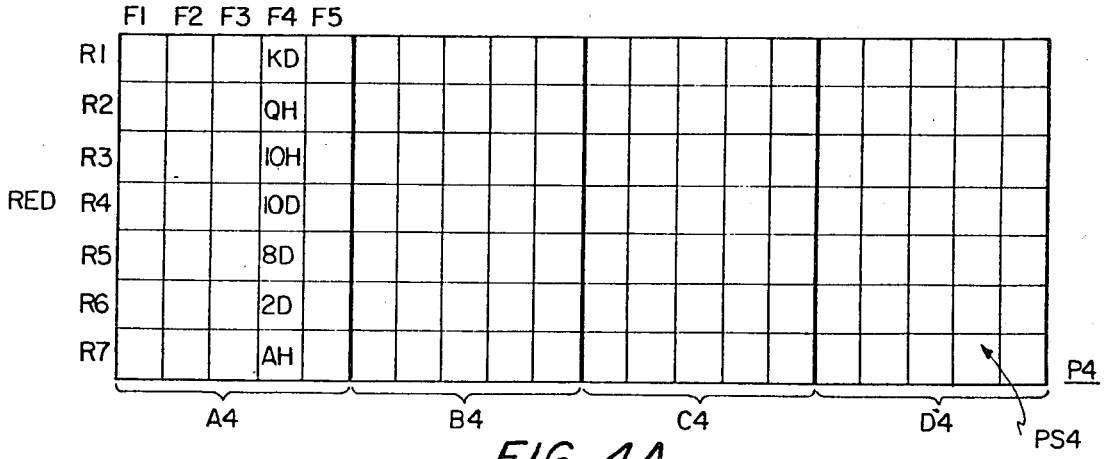
FIG. 4A is a schematic of a seven-around print roll of the present invention.
Figure 4B:
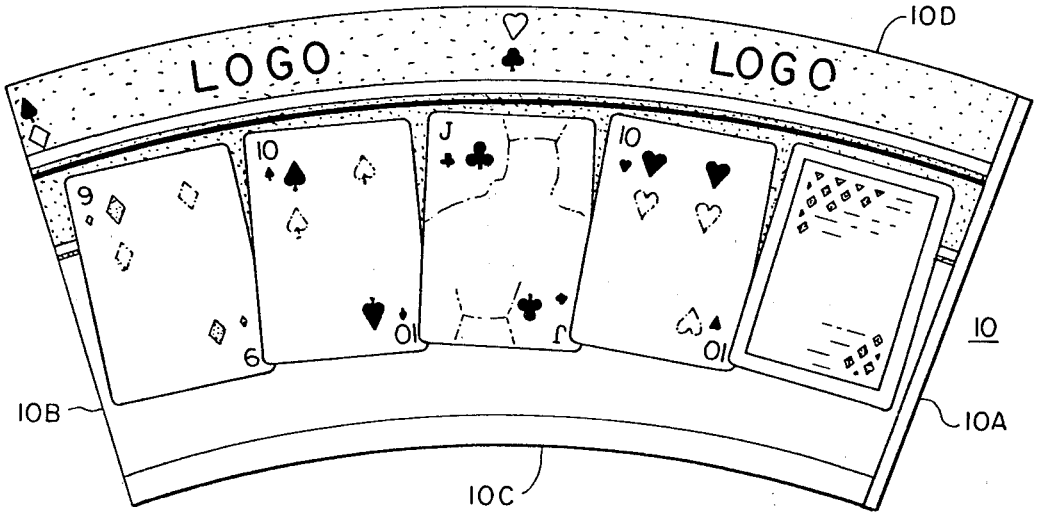
FIG. 4B is a cup blank which has been printed by the first, second, third and fourth print rolls at the third font position of each.

Thus, there remains to be imprinted on the sidewall blank 10, at the fourth printing station corresponding to the fourth print roll P4, the fourth card identity ID4 illustrated in FIG. 4B.

Referring to FIGS. 4A and 4B, it is seen that the four-across print zones A4 . . . D4 are present together with the font positions F1 . . . F5 illustrated in reference to zone A4 with the font positions F1, F2, F3 and F5 being blank, the font position F4 containing the identifications ID4 for the fourth card outline CO4 on the cup blank 10 of FIG. 4B and an additional printing plate corresponding to the row R7 being included around the periphery on the surface PS4 of the print roll P4 for seven-around printing. The printing plate positions corresponding to the rows R1 . . . R7 are as follows:

King of Diamonds, Queen of Hearts, Ten of Hearts, Ten of Diamonds, Eight of Diamonds, Two of Diamonds, and Ace of Hearts.

It can also be seen at this point in time that all of the card identifications ID3 on the print roll P3 were the color black and that all of the card identifications ID4 on the print roll P4 are the color red.

In keeping with the number three row position R3 as the composite hand to be printed on the sidewall blank 10, the indicia ID4 as indicated in FIG. 4B corresponds to the Ten of Hearts such that a possible straight or a pair of tens is showing on the face of the sidewall blank 10.

The poker hand is to be completed by the particular card printed on the bottom blank of the assembled cup as will be hereinafter more fully described.

Figure 5A:
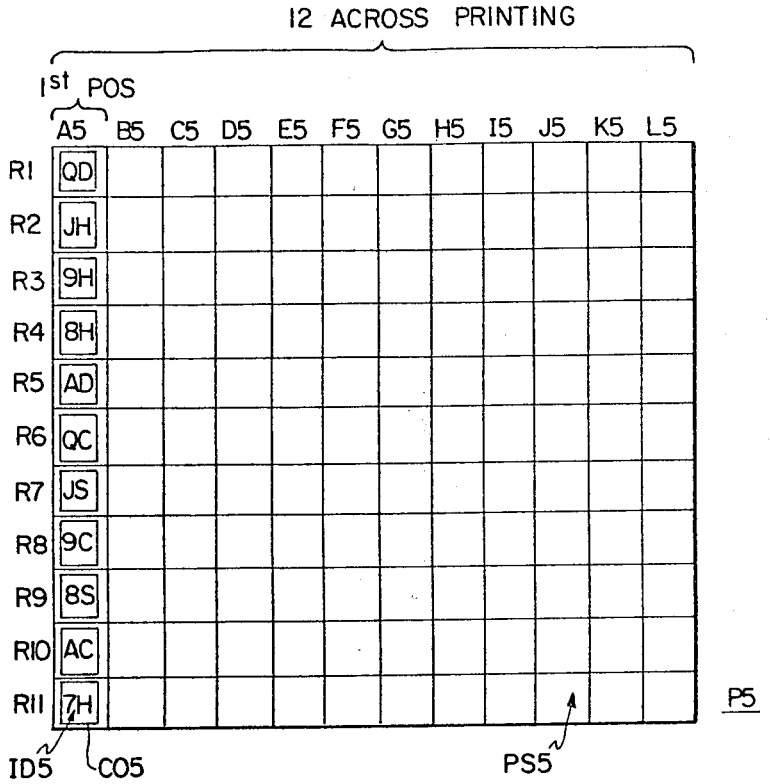
FIG. 5A is a schematic of an eleven-around print roll for printing the bottom stock of the present invention.
Figure 5B:
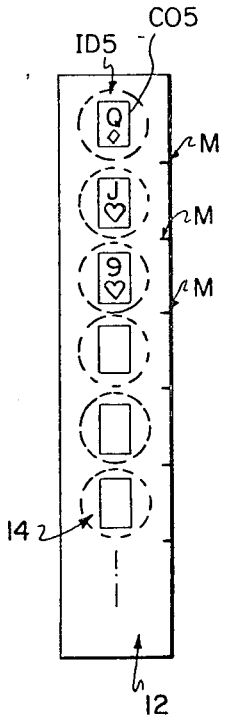
FIG. 5B is a strip of bottom stock printed by the print roll of FIG. 5A.

Referring next to FIGS. 5A and 5B, a fifth print roll P5 having a schematically represented printing surface PS5 is shown as including single card print positions for printing card outlines and card identities CO5 and ID5 adjacent index marks M which are formed along one edge of a strip stock 12 from which cup bottoms 14 are to be blanked. Each cup bottom 14 is circular in configuration and is blanked by a suitable blanking machine during the feed of the strip stock 12 to a cup-making machine with the marks M being utilized, as is well known in the art, as index marks for photoelectric positioning and indexing devices such that a particular bottom blank will be properly received in the machine at the same time as a corresponding cup blank 10.

The surface PS5 of the fifth printing cylinder P5 which operates on the strip stock 12 develops 12-across printing which is provided in an eleven-around configuration corresponding to rows R1 . . . R11, as shown, with the 12-across print zones being identified by the characters A5 . . . L5, respectively. The third row position R3 corresponds to the Nine of Hearts and the resulting bottom blank 14 from the row position R3 is shown both in FIGS. 5B at the position from which the blank 14 is to be cut on the strip stock as well as in place in the bottom of a finished cup 16 which has been illustrated in FIGS. 6 and 7. Thus, the Nine of Hearts completes the hand in FIG. 4B which consisted of the Nine of Diamonds, Ten of Spades, Jack of Clubs and Ten of Hearts previously imprinted on the sidewall 10 of the finished cup 16 such that the resulting poker hand would be a pair of nines, a pair of tens and "Jack high."

Figure 6:
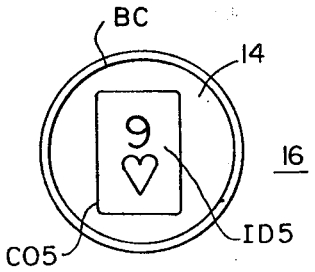
FIG. 6 is an illustration of a bottom blank for a cup which has been printed by the third position of the print roll of FIG. 5A in place as the bottom member of a cup formed with the sidewall blank of FIG. 4B.
Figure 7:
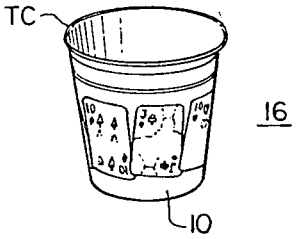
FIG. 7 is an illustration of a cup sidewall formed from the sidewall blank of FIG. 4B.

Referring back to FIG. 4B the lateral right hand and left hand edges 10A and 10B, respectively, of the sidewall blank 10 are lapped to form a side seam resulting in a frustoconical sidewall as shown in the finished cup 16 in FIG. 5B and the arcuate bottom edge 10C is folded in conjunction with a mating portion of the bottom blank 14 to form a bottom curl indicated as BC in FIG. 6 in a manner well known in the art. A similar rolling or folding of the top edge 10D to form a top curl TC illustrated in FIG. 7 is also a standard expedient in the art.

Accordingly, any suitable cup-making machinery which has the capability for indexing a particular series of sidewall blanks formed on the first, second, third and fourth print rolls P1 to P4 with a series of bottom blanks 14 formed on a strip stock 12 by the fifth print roll P5 to assemble them into cups, will result in a plurality of poker hands numbering at least 4,620 distinct permutations and combinations of the various card indicia ID1 . . . ID5 provided on the bottom blanks and sidewall blanks 14 and 10, respectively, by these print rolls.

Additional permutations and combinations also result depending upon the particular registry initially set between the respective print rolls P1 through P4 and the registry of the particular positions R1 through R11 on the fifth print roll P5 with respect to the feed of the bottom blanks 14 through a given machine. For example, by making the first position R1 of the bottom blanking format correspond to other than the first row position R1 of the printing plate format for the sidewall blanks 10, a new series of permutations and combinations of hands results since the hole card or draw card position on the bottom blank 14 will vary in its sequential relationship with the pre-established permutations and combinations eminating from given row positions in the composite printing format established by the first, second, third and fourth print rolls P1 through P4.

In driving the print rolls P1 through P4, the peripheral velocities of each of these rolls, i.e., the rotational velocity at which each row position travels, are made to be identical between the several rolls such that the composite printing is properly indexed and registered on the blanks 10. Thus, all of the first four print rolls P1 through P4 are geared together to maintain proper registry while a state of the art positioning and sensing system is utilized for feeding the bottom blanks 14 in registry with the sidewall blanks 10 when these are blanked from strip stock and fed through conventional or other state of the art cup-making machinery.

Therefore, it can be seen that the present invention provides a facile and desirable approach for printing a promotional amusement in the form of a card game such as poker on the sidewalls and bottom of beverage or food dispensing two-piece containers of the conventional frustoconical type and which provides a maximized number of permutations and combinations of ultimate hands to be achieved in the game consistent with minimizing the amount of equipment needed to achieve this end.

It should be understood that the METHOD FOR IMPRINTING MULTIPLE PERMUTATIONS AND COMBINATIONS OF CARDS and the like on drinking cups and products manufactured thereby may be modified as would occur to one of ordinary skill in the art without departing from the spirit and scope of the present invention.

It is claimed:

1. The method of printing a plurality of container sidewall blanks in sequence on a strip of stock material and providing said blanks in said sequence with combinations of the same number of generically related discrete indicia such that no two successive blanks bear the same combination by the steps of:

moving said strip of stock through a printing zone from an upstream position to a downstream position;

providing a first repetitive number of first sidewall blank imprints in succession to said strip of stock at said upstream position, each of said first imprints in said repetitive number containing a different discrete indicia; and providing at least a second repetitive larger number of second sidewall blank imprints at a downstream position with each of said second imprints being in registry on said stock with a said first imprint, and with each said second imprint containing a different discrete indicia from any other first and second imprint.

2. The method of claim 1, which further includes:

providing at least third and fourth repetitive and increasingly larger respective numbers of third and fourth sidewall blank imprints at respective downstream positions with each of said third and fourth imprints being in registry on said stock with a previously provided imprint, with each of said third and fourth imprints containing a different discrete indicia from any other first, second, third and fourth imprint;

said discrete indicia corresponding to playing card identities and said sidewall blanks, when completed, including four card combinations comprising the first four cards of a poker hand.

3. The method of printing a plurality of sidewall blanks and bottom blanks and assembling a sequence of two-piece containers therefrom in which correlated game indicia on said sidewalls and on said bottom blanks are provided in a sequence of assembled cups such that a combination of such indicia on each cup will differ from such a combination on any other cup in said sequence, comprising:

the method of printing a pluralty of container sidewall blanks in sequence on a strip of stock material and providing said blanks in said sequence with combinations of the same number of generically related discrete indicia such that no two successive blanks bear the same combination by the steps of:

moving said strip of stock through a printing zone from an upstream position to a downstream position;

providing a first repetitive number of first sidewall blank imprints in succession to said strip of stock at said upstream position, each of said first imprints in said repetitive number containing a different discrete indicia; and providing at least a second repetitive larger number of second sidewall blank imprints at a downstream position with each of said second imprints being in registry on said stock with a said first imprint, and with each said second imprint containing a different discrete indicia from any other first and second imprint; and moving a second strip of stock through a second printing zone and providing a still larger number of additional discrete indicia generically related to the sidewall blank indicia at successive positions along said second strip of stock corresponding to a respective number of bottom blanks to be extracted therefrom;

said additional discrete indicia being different from one another and from any of said discrete indicia on said sidewall blanks;

sequentially blanking said sidewall blanks and said bottom blanks from their respective strips of stock; and sequentially assembling the resulting said sidewall blanks with said bottom blanks to form said sequence of two-piece containers.

4. The method of claim 3, which further includes:

providing at least third and fourth repetitive and increasingly larger respective numbers of third and fourth sidewall blank imprints at respective downstream positions with each of said third and fourth imprints being in registry on said stock with a previously provided inprint, and with each of said third and fourth imprints containing a different discrete indicia from any other first, second, third and fourth imprint;

said discrete indicia corresponding to playing card identities and said sidewall blanks, when completed, including four card combinations comprising the first four cards of a poker hand; and said bottom blanks including the fifth card of said poker hand.

* * * * *